US009512844B2

(12) United States Patent
Blaser et al.

(10) Patent No.: US 9,512,844 B2
(45) Date of Patent: Dec. 6, 2016

(54) PUMP ASSEMBLY

(75) Inventors: Georg Blaser, Asperg (DE); Jens Kehrbaum, Asperg (DE)

(73) Assignee: Grundfoe Holding a/s, Bjerringbro (DK)

( * ) Notice: Subject to any disclaimer, the term of this patent is extended or adjusted under 35 U.S.C. 154(b) by 219 days.

(21) Appl. No.: 13/586,943

(22) Filed: Aug. 16, 2012

(65) Prior Publication Data

US 2013/0052039 A1 Feb. 28, 2013

(30) Foreign Application Priority Data

Aug. 29, 2011 (EP) ..... 11 179 202

(51) Int. Cl.

| | |
|---|---|
| ***F04D 15/00*** | (2006.01) |
| ***G04C 23/00*** | (2006.01) |
| ***G04G 9/02*** | (2006.01) |
| ***G04G 15/00*** | (2006.01) |
| *F04D 13/06* | (2006.01) |

(52) U.S. Cl.

CPC ..... *F04D 15/00* (2013.01); *F04D 13/0686* (2013.01); *G04C 23/00* (2013.01); *G04G 9/02* (2013.01); *G04G 15/006* (2013.01); *F04D 13/06* (2013.01)

(58) Field of Classification Search

CPC ..... F04D 13/06; F04D 15/00; F04D 13/0686; G04C 23/00; G04G 9/02; G04G 15/006; F04B 49/00; G04F 1/005

USPC ..... 417/12, 63, 410.1; 368/82, 83, 240

See application file for complete search history.

(56) References Cited

U.S. PATENT DOCUMENTS

| | | | | |
|---|---|---|---|---|
| 3,922,847 | A * | 12/1975 | Culley et al. | 368/240 |
| 3,987,617 | A | 10/1976 | Slob | |
| 4,041,692 | A | 8/1977 | Marshino | |
| 4,095,414 | A * | 6/1978 | Reich | G04G 9/022 368/240 |
| 4,110,967 | A * | 9/1978 | Fujita | 708/111 |
| 4,566,802 | A * | 1/1986 | Koehler | 368/9 |
| 4,569,020 | A * | 2/1986 | Snoddy et al. | 700/284 |
| 4,647,217 | A * | 3/1987 | Havel | 368/10 |
| 4,702,615 | A * | 10/1987 | Havel | 368/82 |
| 5,410,520 | A * | 4/1995 | Stampfer | 368/240 |
| 5,819,848 | A * | 10/1998 | Rasmuson et al. | 166/250.15 |
| 5,829,467 | A * | 11/1998 | Spicher | 137/14 |
| 6,065,946 | A * | 5/2000 | Lathrop | 417/423.14 |
| 6,137,416 | A * | 10/2000 | Meador | 340/606 |
| 6,212,894 | B1 * | 4/2001 | Brown et al. | 62/180 |

(Continued)

FOREIGN PATENT DOCUMENTS

| | | |
|---|---|---|
| DE | 8914657 U1 | 2/1990 |
| DE | 4203127 A1 | 8/1992 |

(Continued)

OTHER PUBLICATIONS

Grundfos Instructions: Comfort System Hot Water Recirculation System, Oct. 2005, Grundfos.*

(Continued)

*Primary Examiner* — Devon Kramer
*Assistant Examiner* — Joseph Herrmann
(74) *Attorney, Agent, or Firm* — Panitch Schwarze Belisario & Nadel LLP

(57) ABSTRACT

A pump assembly includes a centrifugal pump driven by an electric motor and is provided with a time display which is formed by an annular row of light diodes, wherein a time is assigned to each light diode.

13 Claims, 3 Drawing Sheets

(56) References Cited

U.S. PATENT DOCUMENTS

| | | | | |
|---|---|---|---|---|
| 6,388,952 | B2 * | 5/2002 | Kim | 368/74 |
| 2001/0029407 | A1 * | 10/2001 | Tompkins et al. | 700/300 |
| 2009/0316533 | A1 * | 12/2009 | Liu | 368/10 |
| 2010/0090635 | A1 * | 4/2010 | Andersen et al. | 318/490 |
| 2010/0096246 | A1 * | 4/2010 | Pippel et al. | 200/313 |
| 2010/0247352 | A1 * | 9/2010 | Hansen et al. | 417/410.1 |
| 2010/0310382 | A1 * | 12/2010 | Kidd et al. | 417/12 |

FOREIGN PATENT DOCUMENTS

| | | | | |
|---|---|---|---|---|
| DE | 29710663 | U1 | 11/1997 | |
| DE | 102008033859 | A1 | 1/2010 | |
| EP | 459141 | * | 12/1991 | G05B 19/04 |
| EP | 0459141 | A2 | 12/1991 | |
| EP | 1 063 751 | A1 | 12/2000 | |
| EP | 1063751 | A1 * | 12/2000 | H02K 5/22 |
| EP | 1715394 | A2 | 10/2006 | |
| EP | 2071417 | A1 | 6/2009 | |
| JP | 54-124764 | A | 9/1979 | |

OTHER PUBLICATIONS

EP1063751: English Translation of Specification, Dec. 27, 2000, Grundfos.*

Deutsche Vortex Blue One instruction manual dated Jan. 3, 2011.*

Vortex BlueOne document dated Jul. 2011.*

Grundfos ALPHA1 2009-2010.*

Grundfos Comfort 2000; Apr. 25, 2001.*

Thomson Reuters. "EP 1063751 A1 (translation with Derwent / Thomson Reuters Translation Included)." Derwent. Thomson Reuters, Dec. 27, 2000. Web. Jan. 10, 2016.*

Search Report issued Feb. 8, 2012 in EP Application No. 11179202.4.

Armstrong, "Hot Water Re-circulation Systems", Published May 4, 2009, found on the Internet at http://www.armstrongpumps.com/Data/pdfbrochures/Links/01_05_002/10.121_Astro_T-TA_brochure.pdf, retrieved on Jan. 24, 2012.

"Wilo-Star-Z 15 TT drinking-water circulation pump", found on the internet at http://www.wilo.cz/cps/rde/xbcr/cz-cs/Typenuebersicht_StarZ_GB.pdf, retrieved on Jan. 24, 2012.

Watts, "Instant Hot Water Recirculating System", published Jan. 14, 2009, found on the internet at http://media2.wattswater.com/IS-IHWRS.pdf, retrieved on Jan. 24, 2012.

Grundfos, "Hot Water in an Instant", published Nov. 10, 2006, retireved from the internet at http://solarwaterwise.com.au/downloads/Grundfos-Comfort-Final-10-11-06.pdf, retrieved on Jan. 24, 2012.

* cited by examiner

PUMP ASSEMBLY

BACKGROUND OF THE INVENTION

Embodiments of the invention relates to a pump assembly with the features specified below. Such pump assemblies are known and are mostly applied as circulation pumps for hot potable water circulation. Since the hot water circulation is typically only required for a brief period, specifically mostly only during the day and often also only at specific times, it is common in a few heating installation controls, to switch off the circulation pump in times, in which it is not required, in order in this manner to reduce the heat losses in the circulation conduit.

For circulation pumps which are applied in an independent manner, it is counted as belonging to the state of the art to provide a time control on the pump itself, so that at the pump itself, one may set the times at which the pump is switched on, and the times at which the pump is switched off. Such a pump is, for example, described in "Grundfos Circulation Pump Comfort UP 15-14 BUT". With regard to this, a mechanical time switch is provided at the face-end of the pump housing, and this time switch, as is common with such mechanical time switches, comprises a ring moved by clockwork, on which riders (slides) are arranged at a quarter of an hour or half an hour intervals, which may be brought from an inner to an outer position, wherein these riders activate a mechanical switch which switches the motor of the pump on or off, depending on the rider position.

Such time controls have proven their worth, since they are quasi self-explanatory and may also be set by the amateur without operating instructions. However, the disadvantage thereby is the fact that the mechanical clockwork as well as the mechanical switch require some effort with regard to manufacture and are prone to error. Moreover, the electrical clockwork requires energy.

Electronic time switches are known, with which the mechanical switch is replaced by an electronic one, and an electronic, typically a digital clock is provided, which has a display which displays the time and/or switch times and may be programmed via buttons. A disadvantage of these time switches however is the fact that the setting and programming as a rule is only possible after careful study of the operating instructions. Moreover, the display is comparatively costly and is also prone to breakdown, in particular with humid room atmospheres. With a failure of the display, the pump assembly may practically no longer be used independently of its switch function.

BRIEF SUMMARY OF THE INVENTION

Against this background, it is the object of the invention to provide a pump assembly of the known type, which on the one hand has the advantage of good readability, a simple operability and the robustness of a mechanical time switch, but on the other hand has the advantages of an electronic, in particular digital time switch.

The pump assembly according to embodiments of the invention includes a centrifugal pump and an electric motor which drives this and is equipped with a time control for the motor as well as with a time display. According to embodiments of the invention, the time display is formed by a number of illumination devices and a time is assigned to each illumination device.

The basic concept of the solution according to the invention therefore, although being able to provide an electronic time control for the motor, however is thus of forming the time display by a number of illumination devices, to which a time is assigned in each case. In this manner, despite an electronic control, one may ensure a simple operability of the time control, and readability of the time display, even if the control is effected electronically, preferably digitally. Moreover, the application of illumination devices has the advantage that even with a failure of one of the illumination devices, the function of the remaining illumination devices is maintained and thus the pump assembly may also continue to be used.

The application of illumination devices instead of mechanical riders permits a compact constructional shape, a simple operability and a good recognisability, in particularly also in dark corners of basements where such pumps are often installed.

The solution according to the invention, with a suitable selection of time control and illumination devices, moreover permits a low-energy operation and in particular the making-do without mechanical switches. The control and the display may be completely encapsulated, so that one may make do without complicated sealing systems for mechanical elements.

Advantageously, according to a further formation of the invention, the time display is designed for representing the time of day as well as for representing the settable switching time. Thereby, separate illumination devices may be provided either for representing the time of day or for representing the switching time, or the illumination devices may be activated differently for the display of both times, be it in a different colour or different illumination intensity or with different illumination times (flashing).

Advantageously, the illumination devices are arranged in at least one row, wherein if, for example, different time displays are provided for the time of day and the settable switching time, then advantageously two rows of illumination devices are provided, which are arranged next to one another in a manner such that in each case the same time is assigned to the rows, so that a simple operation is ensured.

The readability and operability is fashioned in a particularly suitable manner if, according to a further formation of the invention, two rows of illumination devices, preferably of a different colour, are arranged next to one another, wherein one row is envisaged for displaying the time of day and the other row for displaying the switching time.

It is usefully to arrange the illumination devices in annular, preferably circularly annular rows, thus in the manner of an analog clock, in order to permit an as intuitive as possible readability and operability. Thereby, an illumination device ring may advantageously represent 24 or 12 hours. With the 12-hour representation, a further display for day, night or for am, pm, as is common in the English-speaking world, may be useful. If an illumination device ring represents 24 hours according to an analog clock, then this simplifies the operability and readability, in particular whilst taking into account the widespread mechanical switching clocks with riders which are constructed in this manner. A comparable functionality may then be formed in an electronic manner.

As to which illumination devices are applied, is basically dependent on what is economically favourable, i.e., with regard to inexpensive price and low consumption values. At the present time, these are light-emitting diodes (LEDs), but it is indeed conceivable that other illumination devices which are even more economical will be available in the future.

Advantageously, the pump assembly is designed such that at least in the region of the motor, it has a housing which in cross section is round, preferably circularly round and which at the side which is away from the pump ends in a preferably plane end-wall and that the time display is arranged on this end-wall. Such an arrangement is particularly favourable with regard to the operability and readability, since the end-side of this end-wall may be distanced farthest from the pipe conduit with the inline pumps which are common today and thus may be closest to the operator. It is to be understood that the motor housing may also have a rectangular cross section, preferably rounded at the corners, or another cross section, and then the end-wall should also have a corresponding outer contour, wherein the illumination device ring or rings may follow this contour or also be circularly round.

Thereby, usefully operating elements for the time control are likewise arranged on the end-wall.

Typically, this end-wall forms part of a control and connection housing, which connects to the motor housing in the axial direction and houses a circuit board which carries the illumination devices and operating elements, wherein recesses for the illumination devices or, as the case may be, fibre-optics connected thereto and for operating elements on the circuit board, are provided in the end-wall. This circuit board, as the case may be, may form part of the motor control and also include parts of the motor electronics. It is particularly favourable if this circuit board exclusively includes the electronics provided for the time control and time display, since a modular construction of pump assemblies of this type is possible, with and without a time-control or also with a different control. This circuit board is then merely to be removed or exchanged.

Advantageously, the end-wall is closed off to the outside by a film provided with marks (i.e., designation marks), said film on the one hand designating the operating elements and on the other hand assigning numbers to the light diodes, as is usual with an analog clock. Thereby, the film usefully partially printed, so that it is through-shining in the region of the light diodes and in contrast is covered in other regions. This film then forms the sealed closure of the end-wall.

It is useful to provide micro-buttons which are arranged on the circuit board and which are accessible through the recesses in the end-wall and the film, in order to be able to operate the operating elements through the film. Basically, the arrangement of the operating elements and of the rows of illumination means is freely selectable. However, it is particularly favourable if the illumination device rows are arranged on the outside and the operating elements within the ring or rings of illumination devices, since one the one hand this permits a good readability of the illumination devices and one the other hand a compact construction manner.

The fewer operating elements are provided for the control, the more favourable is the construction of the circuit board and thus the more clearly is the operating field laid out. On the other hand, too low a number of operating elements may render the operability more difficult, and advantageously for this reason, a button for the menu selection, a button for the confirmation and a button for the time setting are advantageously provided according to a further embodiment of the invention.

Thereby, advantageously at least three operating conditions may be set by way of the menu selection, specifically the permanent operation of the pump, thus the operating condition "on", the time-controlled operation and the setting operation, wherein it is particularly useful if an individual illumination device is assigned to each operating condition.

Advantageously, a common operating element is provided for setting the time of day and the switching time, wherein the control is designed such that in the operating condition "setting operation", it is always firstly the time of day and then the switching times which are to be set. In this manner, one ensures that always firstly the time of day setting is tested, which, inasmuch as it has already been set correctly, is simply skipped for setting the switching time or otherwise is firstly set once.

Advantageously, apart from the previously described superordinate time control, a second subordinate time control is provided, which during the switch-on times of the superordinate time switch, switches off the motor of the pump after preferably settable intervals. Such a subordinate time switch is particularly energetically advantageous, since as a rule it is not necessary for the pump to run continuously during the complete switching-on interval of for example 30 minutes, but is sufficient if it firstly runs for 10 minutes, then remains switched off for 5 minutes, runs again for 5 minutes, remains switched off for 5 minutes and then once again runs for 5 minutes. The previously mentioned values are only to be understood by way of example. What is important is that this subordinate time switch activates the pump such that it is ensured that the water situated in the circulation conduit is firstly circulated at least once, in order to ensure that hot water is present at each tapping location. The pump may then however be switched off and electrical energy saved, since it requires a certain time until the hot water cools in the circulation conduit, and only then does one need to begin again with the circulation. If, as is useful, the second time control may be set with regard to the length and the repetition rate of the switch-off intervals, then an individual adaptation to the local conditions may be effected, so that the length of the circulation conduit, the type of insulation and the comfort demands of the user may be matched to one another in an optimal manner.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

The invention is hereinafter explained in more detail by way of one embodiment example represented in the drawing. There are shown in the drawings.

DETAILED DESCRIPTION OF THE INVENTION

Figure 1:
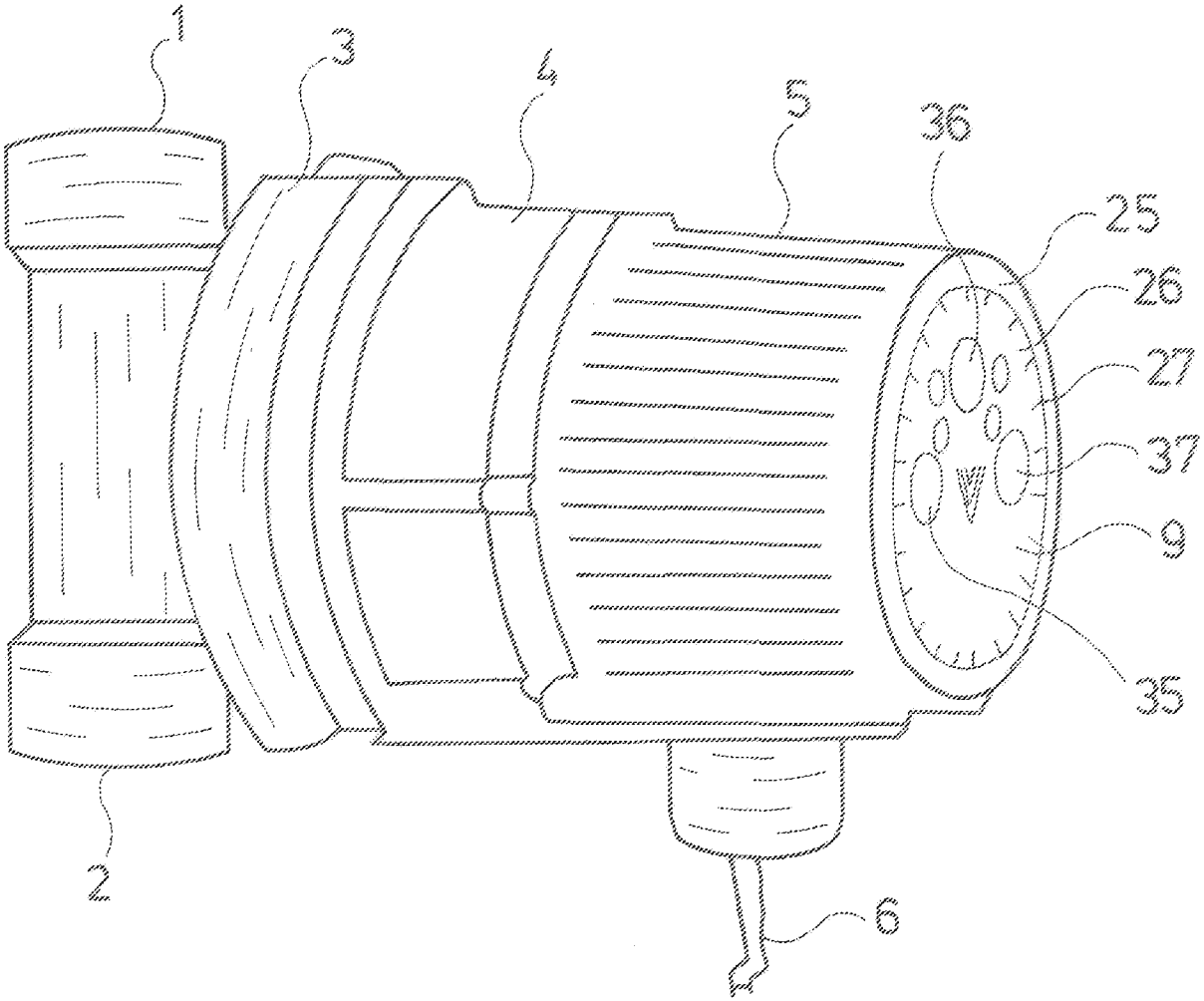
FIG. 1 is in a greatly simplified perspective view, a pump assembly according to an embodiment of the invention.
Figure 4:
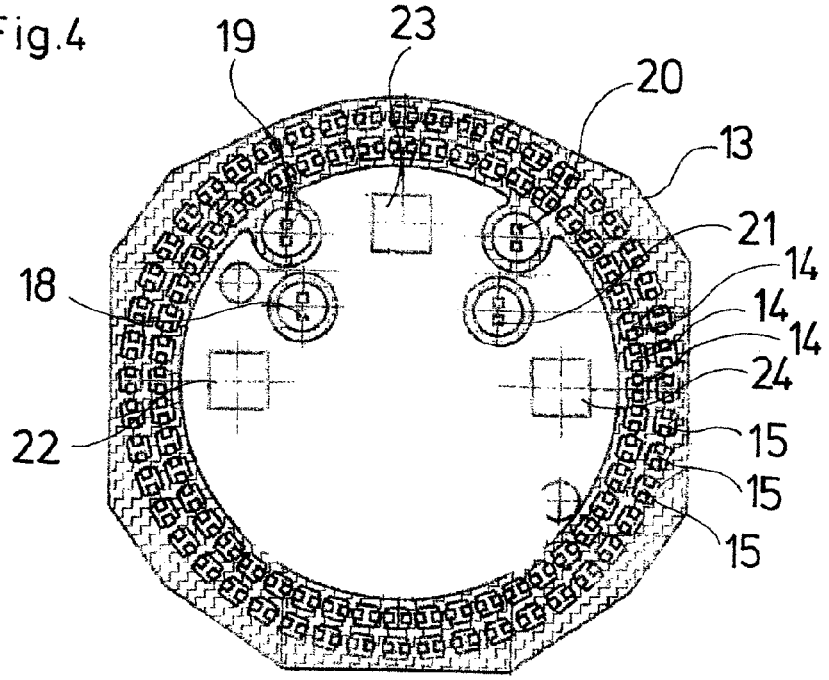
FIG. 4 is a plan view of the circuit board, which is seated below the end-wall represented in FIG. 3.

With regard to the pump assembly represented in FIG. 1, it is the case of a hot water circulation pump for incorporation into a circulation conduit with conduit connections 1 and 2 which are provided for this and which form part of a pump housing 3, in which an impeller which is not visible in the drawing is arranged in the known manner and is seated on a shaft which forms a part of a canned motor, whose motor housing in FIG. 4 connects axially onto the pump housing, and specifically on the opposite side which is away from the conduit connections 1 and 2. A spherical motor is installed in the pump assembly represented in FIG. 1, but a common canned motor may also be applied.

A housing 5 which forms a control and connection housing 5, connects to the motor housing 4 in an oppositely lying manner and away from the pump housing 3. This control and connection housing receives the motor control as well as the frequency converter electronics and simultaneously forms the connection housing, thus a type of terminal box, on whose lower side a connection conduit 6 is led out radially for connection to the electricity mains.

Figure 2:
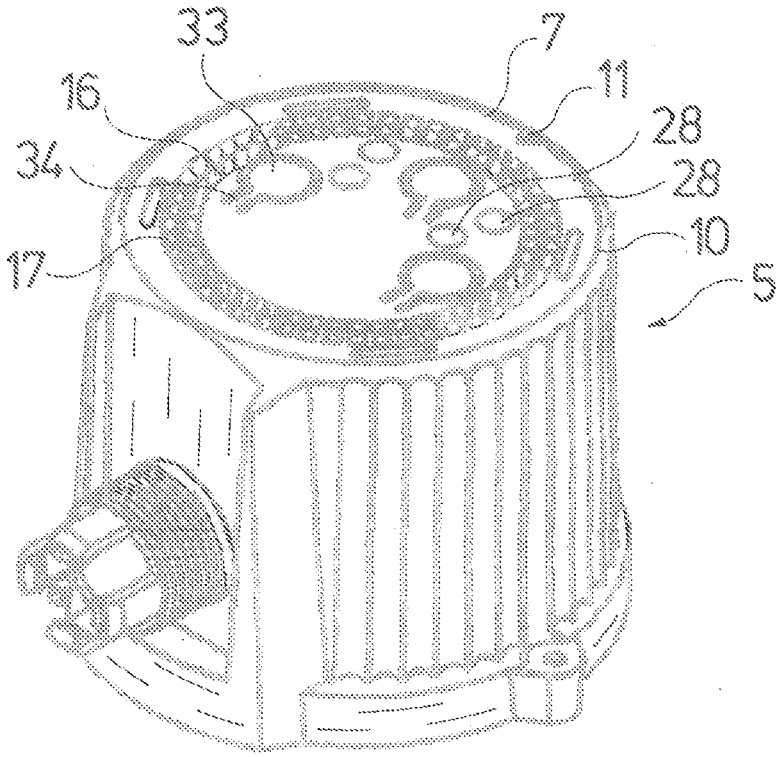
FIG. 2 is in a perspective view, the control and connection housing of the pump assembly according to FIG. 1.
Figure 3:
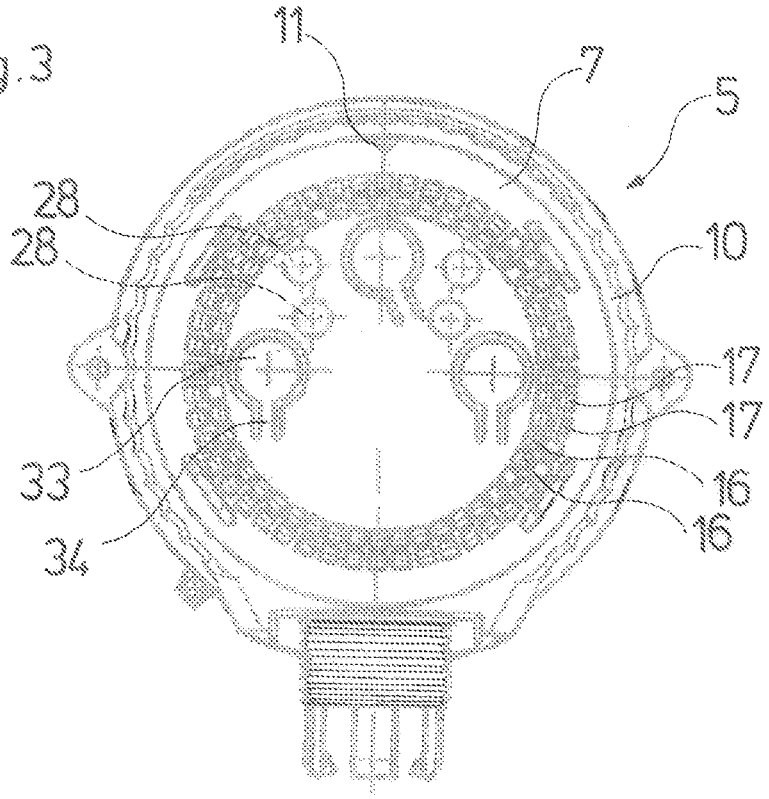
FIG. 3 is a view of the end-wall of the housing according to FIG. 2.
Figure 5:
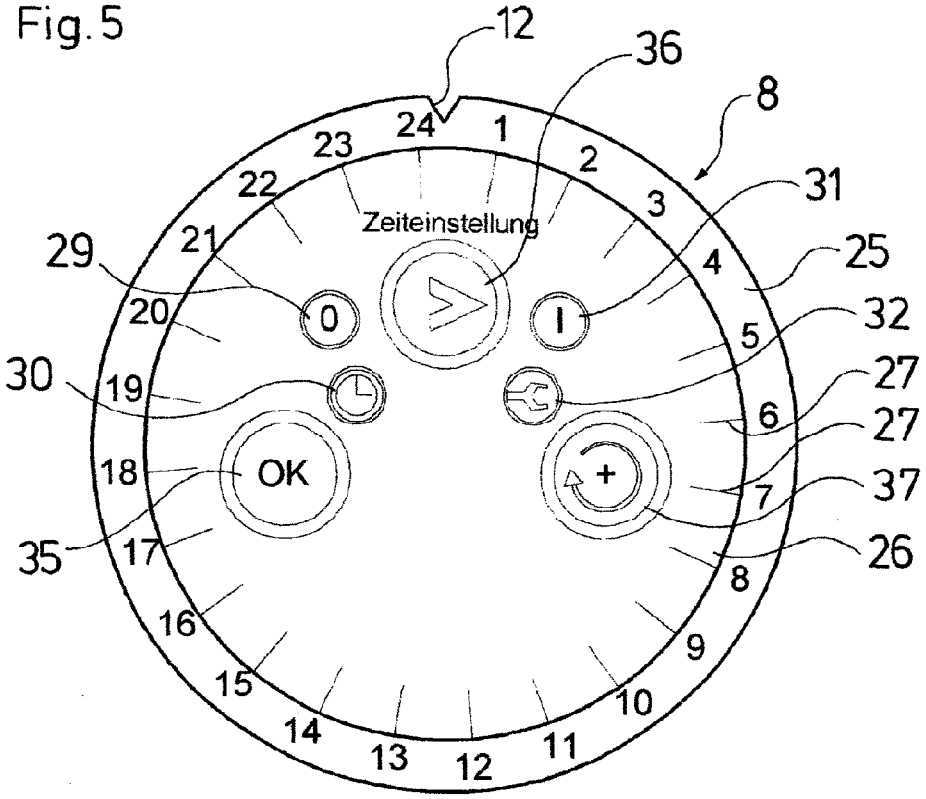
FIG. 5 is a plan view of the film which closes the end-wall according to FIG. 3 to the outside.

This control and connection housing 5 is designed as a plastic injection moulded part and is shown in detail in FIGS. 2 and 3. It includes an end-wall 7 with a free, plane end-side which is closed off by the printed film 8 which is represented in FIG. 5 and which forms a display and operating panel 9 of the pump.

The control and connection housing 5 has an essentially cylindrical shape which tapers in a slightly truncated-cone-like manner from the motor housing 4 to the display and operating panel 9. The end-wall 7 which closes off the housing at the end-side is encased on the peripheral side by a slightly raised edge 10 which in a flush manner receives the printed film stuck on the outer end-side of the end-wall 7. In order to ensure the positioning of the circular film 8 within the edge 10 on the end-wall 7, an inwardly pointing projection 11 which corresponds to a recess 12 in the outer periphery of the film 8 is provided in the edge 10, and ensures that the film 8 is always arranged in the correct angular position on the end-wall 7.

Functionally, the display and operating panel is closed off by the film 8, is carried by the end-side of the end-wall 7 of the control and connection housing 5 which lies therebehind and is completed by a circuit board 13 which is arranged parallel and directly behind this end-wall 7 and which carries the actual display and operating elements. Two rows of light diodes 14 and 15 are arranged concentrically and annularly in one another on this circuit board 13, wherein the light diodes 14 forming the inner ring are green and the light diodes 15 forming the outer ring are red. The light diodes 14 and 15 are arranged over an annular surface in a uniformly distributed manner, and thereby each ring consist in total of 48 light diodes 14 and 15. The light diodes 14 and 15 are thereby not only arranged in an annular manner, but are also directed such that in each case they lie in a paired manner on an imagined radial line. Two annular rows of recesses 16 and 17 are provided in the end-wall 7 of the control and connection housing, corresponding to the arrangement of the light diodes 14 and 15 on the circuit board 13, and the light diodes 14 and 15 project into these recesses when the circuit board 13 is assembled in the housing 5. The circuit board 13 is held on the end-wall 7 of the housing 5 via snap closures located in the end-wall, so that the light diodes 14 and 15 lie in the end-wall 17.

The electronic components which permit the time switch control and its operation which will yet be described in detail hereinafter, are deposited on the circuit board 13 on its lower side and are therefore not seen in the figures. The construction of such circuits by way of discrete microelectronic components is generally known and a description of the construction of the digital circuit has therefore been omitted.

Furthermore, the circuit board 13 at its side facing the end-wall 7 of the housing 5 carries four light diodes 18, 19, 20 and 21 which are arranged within the ring rows of light diodes 14 and 15, as well as three micro-buttons 22, 23, and 24 which likewise lie within the light diode rings 14 and 15.

In the assembled condition of the display and operating panel 9, in which the circuit board 13 is arranged directly below the end-wall 7 of the housing 5, its end-side is covered by the printed film 8. The printed film 8 has an outer, light-impermeable ring 25 which carries the number 1 to 24 which symbolise the hours of a day, similarly to an analog clock, but not with 12 but with 24 hours as is also common with mechanical time switch clocks.

A ring 26 which although covering the end-side 7 with its recesses, said end-side being located thereunder, is however transparent and lies within this opaque ring 25 with the number markings representing the hours of the day, concentrically thereto. This ring 26 is divided by twenty four radial lines (dashes) 27 corresponding to the numbers in the ring 25. In the installed condition, the annular rows of light diodes 14 and 15, which project through the rows of recesses 16 and 17 arranged corresponding to this in the end-wall 7, lie below the ring 26 in a manner such that in each case two green light diodes 14 as well as two red light diodes 15 next to this radially to the outside, are arranged between two lines 27.

The light diodes 18 to 21 on the circuit board 13 likewise lie within recesses 28, and specifically recesses 28 in the end-wall 7 of the connection housing 5. They lie below the film below four transparent displays 29, 30, 31 and 32, of which the display 29 is characterised by a zero for the operating condition "off" of the pump, the display 30 by a clock symbol for the display of a clock setting mode, the display 31 by a one for the operating condition "on" and the display field 32 by a symbolised spanner for the setting mode.

The display 29 is thus illuminated by the light diode 19, the display 30 by the light diode 18, the display 31 by the light diode 20 and the display 32 by the light diode 21.

Furthermore, cuts are provided in the region of the micro-buttons 22 to 24 in the end-wall 7 of the housing 5, and these correspond roughly to the outer contour of a saucepan seen from the top. These cuts in the housing wall 7 form circular touch-bodies 33 as well as spring tongues 34 which are arranged such that the touch-bodies 33 lie between the micro-buttons 22 to 24 and the respective touch buttons 35, 36 and 37 of the film 8. Due to the fact that the touch-bodies 33 are only connected to the end-wall 7 of the housing 5 via spring tongues 34, these may be accordingly moved by way of pressure on the touch buttons 35 to 37, and the micro-buttons 22 to 42 located therebelow close the contact. On release, the touch-bodies 33 spring back, so that the micro-buttons 22 to 24 return back into their initial position, i.e. opened position. Thereby, the touch button 35 is assigned to the microswitch 22 and is provided for confirmation of an input. The touch button 36 is assigned to the micro-button 23 and serves for menu selection, whilst the touch button 37 is assigned to the micro-button 24 and serves for setting.

In operation, the red light diodes 15 which are arranged in the outer row serve for the display of the current time. One of these forty-eight red light diodes always lights, according to the current time. If this for example the first light diode 15 between the lines 27 indicating the numerals 2 and 3 in the ring is lit, then the current time is between 02.00 o'clock and 02.30 o'clock when the clock time is set correctly.

The row of green light diodes 14 which forms the inner light diode ring shows the switch times of the clock, and specifically thereby the light diodes which represent the switched-on times of the pump, are lit, and the remaining green light diodes are not connected in an illuminating manner.

For starting operation of the pump, the touch button 36 is firstly to be actuated, whereupon with the pump connected to the mains, the display 29 which was lit until then and which symbolises the operating condition "off", goes from the lit into the non-lit condition, and the display 31 which symbolises the permanent operation of the pump, is lit. If the touch button 36 is pressed yet again, the display 32 which symbolises the setting mode is lit. If pressed once again, the display 30 which symbolises the time switch operation lights up.

For setting the clock time and the switching time, firstly one goes into the setting mode by way of the touch button 36, which means pressing it until the display 32 lights up. In this mode, firstly the current clock time may be set by way of the touch field 37. Thereby the red light diodes 15 light up one after the other beginning from the uppermost close to the recess 12, wherein a preceding light diode 15 goes out with each pressing of the button and a subsequent one lights up, similarly to an analog clock, whose dial is rotated by 360°. As soon as the illuminating red light diode 15 corresponds to the current clock time in the 24-hour mode, then this is confirmed by way of the touch button 35, whereafter now the green light diodes 14 of the inner ring may be controlled one after the other by way of further pressing the touch button 37. When a green light diode 14 illuminates, this symbolises the switch-on time of the pump according to the assigned time in the ring 25. This time interval may be activated by way of pressing the touch button 35 and may be deactivated by pressing it once again. Thus infinite time intervals for switching on the pump may be activated or for switching off the pump may be deactivated with the help if the touch buttons 37 and 35, i.e., here a time programming in half-hour steps is possible with forty eight light diodes. As soon as the programming of the switch-on times is completed, the touch button 36 is activated, so that one goes over into the time-switch mode which is symbolised by the display 30 which then lights up. In this mode which is typical for the time switch clock, the current time is displayed in each case by way of an illuminating red light diode of the light diode row 15, whilst the times in which the pump is switched on or will be switched on, are indicated by one or more permanently illuminating green light diodes 14.

It is to be understood that the previously described arrangement of light diodes and buttons for programming is only to be understood by way of example. For example one may have quarter of an hour resolution with an arrangement of ninety-six light diodes in a row, and instead of on-off symbols one may also achieve such a quarter of an hour division by way of a flashing intermediate condition of a light diode.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A pump assembly comprising:

a centrifugal pump driven by an electric motor having a time control with a time display comprising:

a plurality of illumination devices to each of which a time is assigned;

wherein the time display continuously represents present time of day and a settable switching time, wherein the plurality of illumination devices are light emitting diodes and form a first circularly annular row of light emitting diodes having a first color and displaying one of the present time of day and the settable switching time and a second circularly annular row of light emitting diodes concentric to and within the first circularly annular row of light emitting diodes, the second circularly annular row of light emitting diodes having a second color different the first color and displaying the other of the present time of day and the settable switching time, and wherein the illumination devices of the first circularly annular row of light emitting diodes and the illumination devices of the second circularly annular row of light emitting diodes lie in a paired manner on a radial line.

2. The pump assembly according to claim 1, wherein the time control has a superordinate time control mode having a switch-on time and a subordinate time control mode which switches off the motor of the pump in settable intervals when the time control is in the superordinate time control mode.

3. The pump assembly according to claim 1, wherein an operating element is provided for setting both the present of day and the settable switching time, wherein the present time of day is to be set before the settable switching time.

4. The pump assembly according to claim 1, wherein markings for the present time of day are provided, which are arranged around the illumination devices of the first circularly annular row of light emitting diodes in an annular manner.

5. The pump assembly according to claim 1, wherein the first circularly annular row of light emitting diodes and the second circularly annular row of light emitting diodes represents the present time of day and the settable switching time with 24 hours or 12 hours and corresponds to an analog clock.

6. The pump assembly according to claim 1, wherein the pump assembly at least in a region of the electric motor comprises a housing which is round in cross section and which ends in a plane end-wall which is away from the centrifugal pump, and the time display is arranged on the plane end-wall.

7. The pump assembly according to claim 6, wherein the time control comprises operating elements which are arranged on the plane end-wall.

8. The pump assembly according to claim 1, wherein an end-wall is part of a control and connection housing which connects to a motor housing in an axial direction and houses a circuit board on which the plurality of illumination devices and operating elements are arranged, and that recesses for the plurality of illumination devices or fibre-optics connected thereto and for the operating elements on the circuit board are provided in the end-wall.

9. The pump assembly according to claim 8, wherein the end-wall is closed to the outside of the pump assembly by a film provided with markings.

10. The pump assembly according to claim 8, wherein the operating elements are formed by micro-buttons.

11. The pump assembly according to claim 8, wherein the operating elements are arranged within the first circularly annular row of light emitting diodes and the second circularly annular row of light emitting diodes.

12. A pump assembly according to claim 8, wherein the operating elements are formed by, a button for menu selection, a button for confirmation and a button for time setting, respectively.

13. A pump assembly according to claim 12, wherein at least three operating conditions may be set in the menu selection, specifically: permanent operation, time-controlled operation and setting operation, wherein an individual operating condition illumination device of a plurality of operating condition illumination device is assigned to each operating condition.

* * * * *